United States Patent [19]

Bolte

[11] Patent Number: 5,009,364

[45] Date of Patent: Apr. 23, 1991

[54] EASY-OPEN PACKAGE FOR FLUENT MATERIAL

[75] Inventor: Georg Bolte, Vechelde, Fed. Rep. of Germany

[73] Assignee: Schmalbach-Lubeca AG, Braunschweig, Fed. Rep. of Germany

[21] Appl. No.: 463,371

[22] Filed: Jan. 11, 1990

[30] Foreign Application Priority Data

Jan. 19, 1989 [DE] Fed. Rep. of Germany ..... 3901517

[51] Int. Cl.[5] ..... B65D 5/70

[52] U.S. Cl. ..... 229/123.2; 220/270; 229/125.35; 229/160.2

[58] Field of Search ..... 229/123.2, 123.3, 125.08, 229/125.35, 160.2; 220/269, 270; 206/633

[56] References Cited

U.S. PATENT DOCUMENTS

| | | | |
|---|---|---|---|
| 1,459,110 | 6/1923 | Loufek | 229/123.3 |
| 2,745,754 | 5/1956 | Steinbeck | 206/633 |
| 3,314,569 | 4/1967 | Seiferth et al. | 220/270 |
| 3,321,123 | 5/1967 | Collie | 229/125.35 |
| 3,964,670 | 6/1976 | Amneus | 206/633 |
| 3,977,562 | 8/1976 | Wedzik | 206/633 |
| 4,231,487 | 11/1980 | Hasegawa | 220/269 |
| 4,533,063 | 8/1985 | Buchner et al. | 229/125.35 |
| 4,762,246 | 8/1988 | Ashley et al. | 220/270 |
| 4,798,295 | 1/1989 | Rausing | 229/160.2 |

*Primary Examiner*—Gary E. Elkins

*Attorney, Agent, or Firm*—Herbert Dubno; Andrew Wilford

[57] ABSTRACT

An easy-open package for a fluent material comprises an upwardly open base vessel having an annular rim, a foil having an outer periphery engaging the rim and formed inward of the periphery with a nonstraight tear line defining a tearout portion, an open tab engaging the portion within the tear line, and respective bonds securing the foil at its periphery to the rim and securing the tab to the portion within the tear line.

5 Claims, 2 Drawing Sheets

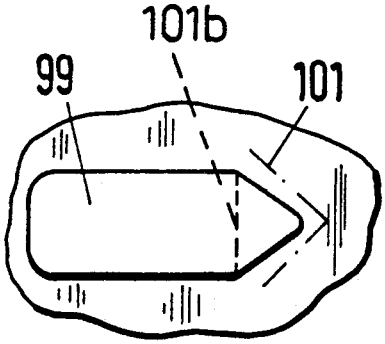
Fig.3
Fig.4
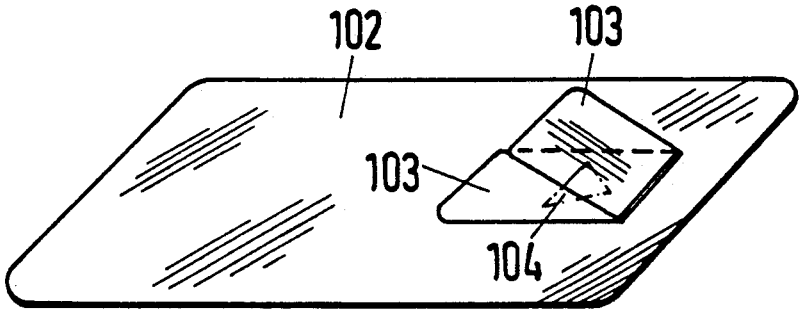
Fig.5
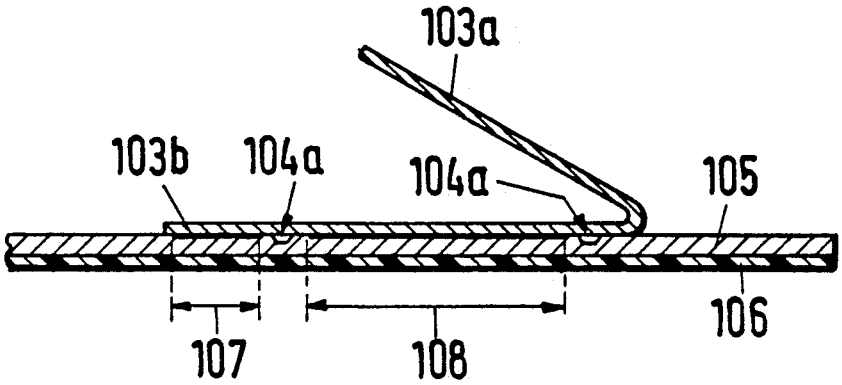

EASY-OPEN PACKAGE FOR FLUENT MATERIAL

FIELD OF THE INVENTION

The present invention relates to an easy-open package. More particularly this invention concerns such a package intended to contain a quantity of a fluent, that is granular or liquid, material.

BACKGROUND OF THE INVENTION

It is known to package a noncarbonated liquid or a fluent granular foodstuff or the like in a package comprised of a cup- or vessel-like bottom part having a rim to which is sealed a flexible foil. Typically the vessel is made of a rigid synthetic-resin and the foil is made as a metal/plastic laminate that is heat sealed or otherwise attached to the rim of the vessel.

The foil is usually formed with a tab that projects past the rim of the cup. This tab is pulled up away from the cup to strip the foil from the rim by separating the foil and the cup at the rim seal.

It is therefore necessary for the manufacturer to make the seal strong enough to safely contain the contents prior to use, yet weak enough that it can be pulled open without tearing the foil. When the error is in the direction of making the bond too strong, the user frequently tears off the tab or cannot open the package without using a tool, or at the very least some of the contents is spilled from the violence of the opening operation. When the seal is too weak it is opened inadvertently during normal handling and the contents are lost or spoiled.

OBJECTS OF THE INVENTION

It is therefore an object of the present invention to provide an improved package for a fluent material.

Another object is the provision of such an improved package for a fluent material which overcomes the above-given disadvantages, that is which is solidly sealed, but which is still relatively easy to open.

SUMMARY OF THE INVENTION

An easy-open package for a fluent material comprises an upwardly open base vessel having an annular rim, a foil having an outer periphery engaging the rim and formed inward of the periphery with a nonstraight tear line defining a tearout portion, an open tab engaging the portion within the tear line, and respective bonds securing the foil at its periphery to the rim and securing the tab to the portion within the tear line.

Thus with this arrangement the tearout portion is easy to remove because it is just a limited area of the cover foil. The tear line is easily breached because it can be cut through the aluminum-layer of an aluminum/-plastic laminate serving as cover foil, leaving the plastic layer intact for good sealing.

According to a further feature of this invention the rim and periphery are generally polygonal and have straight sides, the tear line being V-shaped and adjacent at least one of the sides. In addition the vessel is formed with a spout itself forming a V-shaped extension of the rim and the V-shaped tear line lies immediately adjacent and generally parallel to the V-shaped extension.

Furthermore according to this invention the tear line is annular and generally polygonal, normally triangular. In addition another bond secures the tab to the foil adjacent the tearout portion so that ripping of the foil beyond the tearout portion is limited and so that the torn out piece remains attached to the package to avoid disposal problems.

When according to this invention the tear line is V-shaped and the bond securing the tab to the tearout portion extends to a line closing the V-shaped tear line and forms a bend line for the foil, opening of the package is particularly easy.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIG. 3 a top view of a detail of the package of FIG. 1;

FIG. 4 is a perspective view of a detail of another system according to this invention; and FIG. 5 is a large-scale section through the detail of FIG. 4.

SPECIFIC DESCRIPTION

Figure 1:
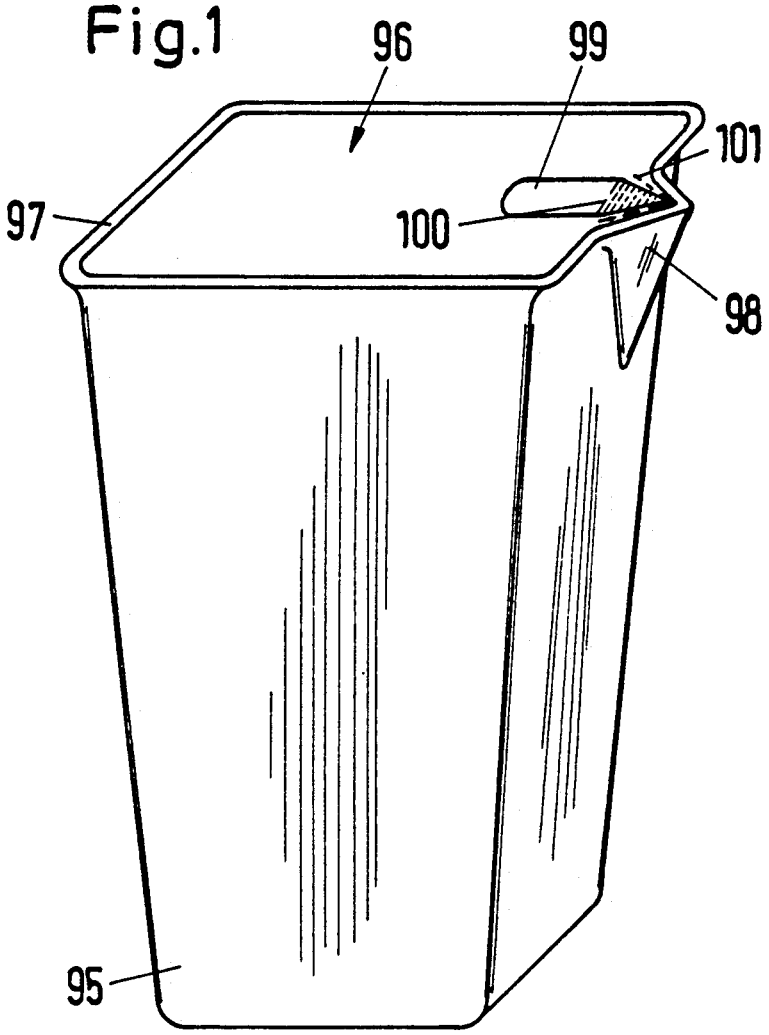
FIG. 1 is a perspective view of a package according to this invention.

As seen in FIG. 1 a downwardly tapered but otherwise generally parallepipedal cup or vessel 95 formed of a stiff synthetic resin, for instance polypropylene, has a planar rim 97 to which is bonded a metal/plastic foil 96. One wall of this vessel 95 is formed at its upper edge with a triangular spout extension 98 around which the rim 97 extends.

The foil 96 is formed with a V-shaped tear line 101 complementary to and just within the periphery of the spout 98. A pull tab 99 has a triangular portion 100 bonded to the foil 96 just within the tear line 101.

Thus when the stiff tab 99 is raised it will rupture the foil 96 along the line 101 and bend a triangular section of the foil 96 inward. This will form an opening from which the contents can easily be poured or into which a straw can be inserted.

Figure 2:
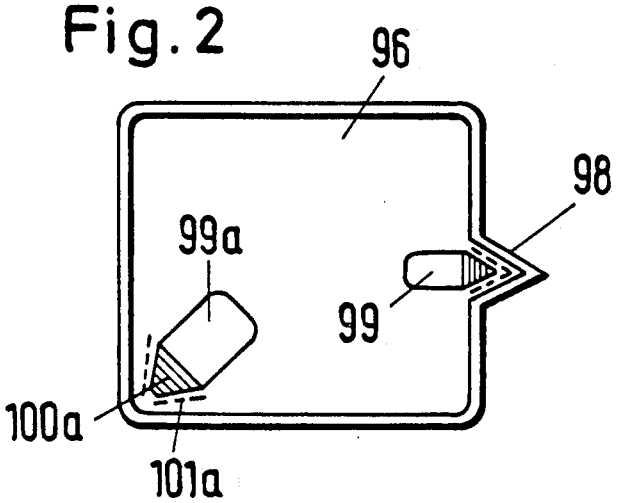
FIG. 2 is a top view of a variant on the package of FIG. 1.

FIG. 2 shows how it is possible to make the V-shaped tear line **101*a* at a corner of the package and a tab 99*a* with a triangular attachment 100*a* is provided just inside this line 101*a* at the corner. In this arrangement the spout 98 and other tab 99 can be eliminated, or the second tab 99*a* can be used to form an air hole to facilitate pouring from the spout 98**.

FIG. 3 illustrates how the line 101 does not extend past the line of attachment **101*b* and forms an acute angle of between 50° and 105°, here an angle slightly larger than the point angle of the triangular tip of the tab 99**.

In FIGS. 4 and 5 a cover foil 102 made of an upper aluminum layer 105 and a lower polypropylene layer 106 is formed adjacent one edge with a triangular tear line **104*a* cut into the aluminum layer 105 and defining a tearout portion 104. This line 104*a* can in fact be part of a larger tear line. A V-shaped flap 103 has one leg 103*a* projecting upward from the foil 102 and another leg 103*b* that is bonded at 108 to the section 104 delimited by the cut 104*a* and at 107 to he foil 102 immediately behind this section 104. The glue section 107 lies at the base of the triangular section 104 and the fold 103***c* between the sections 103*a* and 103*b* at its point.

Thus in this arrangement when the flap 103*a* is lifted the bond 108 will pull the section 104 upward, tearing the foil 102 through at the line 104*a* and ripping the section 104 out of it, leaving a triangular hole. The pull tab 103 and the torn-out section 104 will remain adhered by the bond 107 to the foil 102 adjacent the triangular hole.

I claim:

1. An easy-open package for a fluent material, the package comprising:

an upwardly open base vessel having an annular rim;

a foil having an outer periphery engaging the rim and formed inward of the periphery with an annular tear line defining a tearout portion;

an open tab engaging the portion within the tear line and having one leg lying on the foil and another leg joined at a fold to the one leg and projecting from the foil;

an annular bond securing the foil at the periphery of the foil to the rim;

a bond securing the one leg of the tab to the foil adjacent the tearout portion; and a bond securing the one leg of the tab to the portion within the tear line.

2. The easy-open package defined in claim 1 wherein the rim and periphery are generally polygonal and have straight sides, the tear line being V-shaped and adjacent at least one of the sides.

3. The easy-open package defined in claim 1 wherein the tear line is generally triangular and has a point, the fold lying generally at the point.

4. An easy-open package for a fluent material, the package comprising:

an upwardly open base vessel having an annular generally polygonal rim with straight sides and formed with a spout forming a V-shaped extension of the rim;

a foil having an outer periphery complimentarily engaging the rim and formed inward of the periphery with a V-shaped tear line defining a tearout portion and lying immediately adjacent and generally parallel to the V-shaped extension;

an open tab engaging the portion within the tear line; and respective bonds securing the foil at the periphery of the foil to the rim and securing the tab to the portion within the tear line.

5. An easy-open package for a fluent material, the package comprising:

an upwardly open base vessel having an annular rim;

a foil having an outer periphery engaging the rim and formed inward of the periphery with a V-shaped tear line defining a tearout portion;

an open tab engaging the portion within the tear line;

a bonds securing the foil at the periphery of the foil to the rim; and a bond securing the tab to the portion within the tear line and extending to a line closing the V-shaped tear line and forming a bend line for the foil.

* * * * *